US007421749B2

(12) United States Patent
Herschel

(10) Patent No.: US 7,421,749 B2
(45) Date of Patent: Sep. 9, 2008

(54) BODY SUPPORT FOR MEDICAL APPLICATIONS

(76) Inventor: Hiatt Herschel, 6508 Eagle Ridge, El Paso, TX (US) 79912

( * ) Notice: Subject to any disclaimer, the term of this patent is extended or adjusted under 35 U.S.C. 154(b) by 0 days.

(21) Appl. No.: 11/601,982

(22) Filed: Nov. 20, 2006

(65) Prior Publication Data

US 2008/0115284 A1 May 22, 2008

(51) Int. Cl.
*A61G 13/12* (2006.01)
*A47C 20/02* (2006.01)

(52) U.S. Cl. ..... 5/632; 5/630; 5/646

(58) Field of Classification Search ..... 5/632, 5/630, 633, 634, 624, 636, 646, 623
See application file for complete search history.

(56) References Cited

U.S. PATENT DOCUMENTS 2,887,151 A 5/1959 Springer
3,532,336 A 10/1970 Baker
3,555,582 A * 1/1971 Radford ..... 5/632
4,171,549 A 10/1979 Morrell et al.
4,398,707 A * 8/1983 Cloward ..... 5/632
4,473,913 A 10/1984 Ylvisaker
4,635,306 A 1/1987 Willey
4,969,222 A * 11/1990 Serola ..... 5/630
5,180,386 A * 1/1993 Kennedy, Jr. ..... 606/240
5,970,550 A 10/1999 Gazes
6,345,401 B1 * 2/2002 Frydman ..... 5/636
6,360,387 B1 * 3/2002 Everhart ..... 5/630
6,490,742 B2 * 12/2002 Hall et al. ..... 5/630
6,735,798 B1 5/2004 Sckizawa
6,804,845 B2 10/2004 Stewart et al.

* cited by examiner

*Primary Examiner*—Alexander Grosz
(74) *Attorney, Agent, or Firm*—The Halvorson Law Firm

(57) ABSTRACT

A body support for medical applications comprising a main body piece, at least one expansion piece, and at least one, preferably two arm pieces, which may have their own expansion pieces. All of the pieces are preferably made of soft flexible materials. In one embodiment, the pieces are a soft cloth covering containing an internal cushion without an internal rigid frame. In an alternate embodiment the pieces are a soft cloth covering containing an internal cushion with an internal rigid frame. In yet another alternate embodiment, the pieces are a soft cloth covering containing a rigid or quasi-rigid internal frame and covered with a cushioning padding, such as foam rubber, batting or the like. The main body piece is of a generally triangular prismatic shape and has a single concavity in its front face, proximate the intersection of the front face and the back of the main body piece.

4 Claims, 4 Drawing Sheets

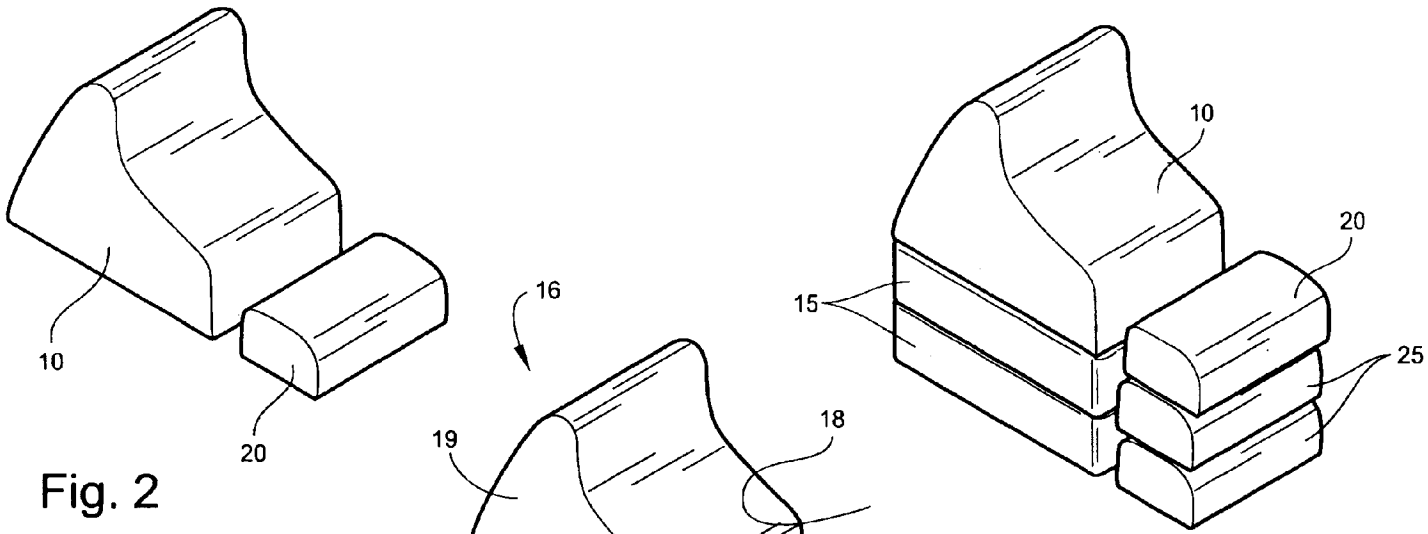
Fig. 4
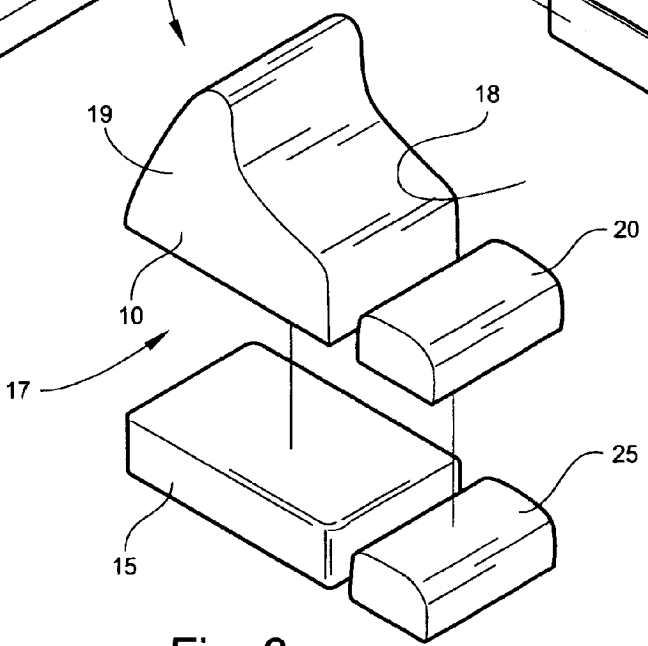
Fig. 3
Fig. 2

BODY SUPPORT FOR MEDICAL APPLICATIONS

FIELD OF THE INVENTION

The present invention relates to the field of body supports for use in medical applications.

BACKGROUND

Hirschsprung's disease is a congenital disorder of the colon in which certain nerve cells, known as ganglion cells, are absent, causing chronic constipation. The lack of ganglion cells, proven by Orvar Swenson to be the cause of the disease, disables the muscular peristalsis needed to move stool through the colon, thus creating a blockage. One in five thousand children suffer from Hirschsprung's. Four times as many males get this disease than females. Hirschsprung's develops in the fetus during the early stages of pregnancy. Typical symptoms for infants include not having their first bowel movement (meconium) within 48 hours of birth, and repeated vomiting. Some infants may have a swollen abdomen. Two thirds of the cases of Hirschsprung's are diagnosed within three months of the birth. Occasionally symptoms do not appear until early adulthood. A barium enema is the mainstay of diagnosis of Hirschsprung's, though a rectal biopsy showing the lack of ganglion cells is the only certain method of diagnosis.

The usual treatment is "pull-through" surgery where the portion of the colon that does have nerve cells is pulled through and sewn over the part that lacks nerve cells (National Digestive Diseases Information Clearinghouse). For a long time, Hirschsprung's was considered a multi-factorial disorder, where a combination of nature and nurture were considered to be the cause (Madsen 19). However, in August of 1993, two articles by independent groups said that Hirschsprung's disease could be mapped to a stretch of chromosome 10. This research also suggested that a single gene was responsible for the disorder. However, the researchers were unable to isolate the single gene that they thought caused Hirschsprung's.

There used to be two steps typically used to treat Hirschspring's. The first stage used to be a colostomy. When a colostomy is performed, the large intestine is cut and an opening is made through the abdomen. This allows bowel contents to be discharged into a bag. Later, when the child's weight, age, and condition is right, a pull-through procedure is performed. The pull-through procedure repairs the colon by connecting the functioning portion of the bowel to the anus. The pull through procedure is the typical method for treating Hirschsprung's in younger patients. Swenson devised the original procedure, but the pull-through surgery has been modified many times. Pull-through procedures used to require a colostomy, but with increased awareness among doctors and parents about the symptoms of Hirschsprung's and with early diagnosis, doctors can keep the colon clean and perform the pull-through procedure without a colostomy. In general, 85 percent of patients that have the pull-through surgery live normal lives afterwards. The other 15 percent have to take a laxative for the rest of their lives.

Frequently these laxatives are administered in a suppository form, requiring the patient to remain in a specific, and often uncomfortable, position for an extended period of time. Thus, there are present and continuing needs for new and improved body support for medical applications, especially those with Hirschsprung's.

SUMMARY OF THE INVENTION

It is an object of the present invention to provide a body support for medical applications.

It is another object of the present invention to provide a body support for medical applications that includes expansion pieces that allow for the customizability of the height, width or depth of the body support.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

FIG. 2 is a perspective view of the body support with arm rest according to the present invention;

FIG. 3 is a perspective view of the body support with arm rest including the height adjustment pads according to the present invention;

FIG. 4 is a perspective view of the body support with arm rest including multiple height adjustment pads according to the present invention;

DESCRIPTION OF PREFERRED EMBODIMENTS

Figure 1:
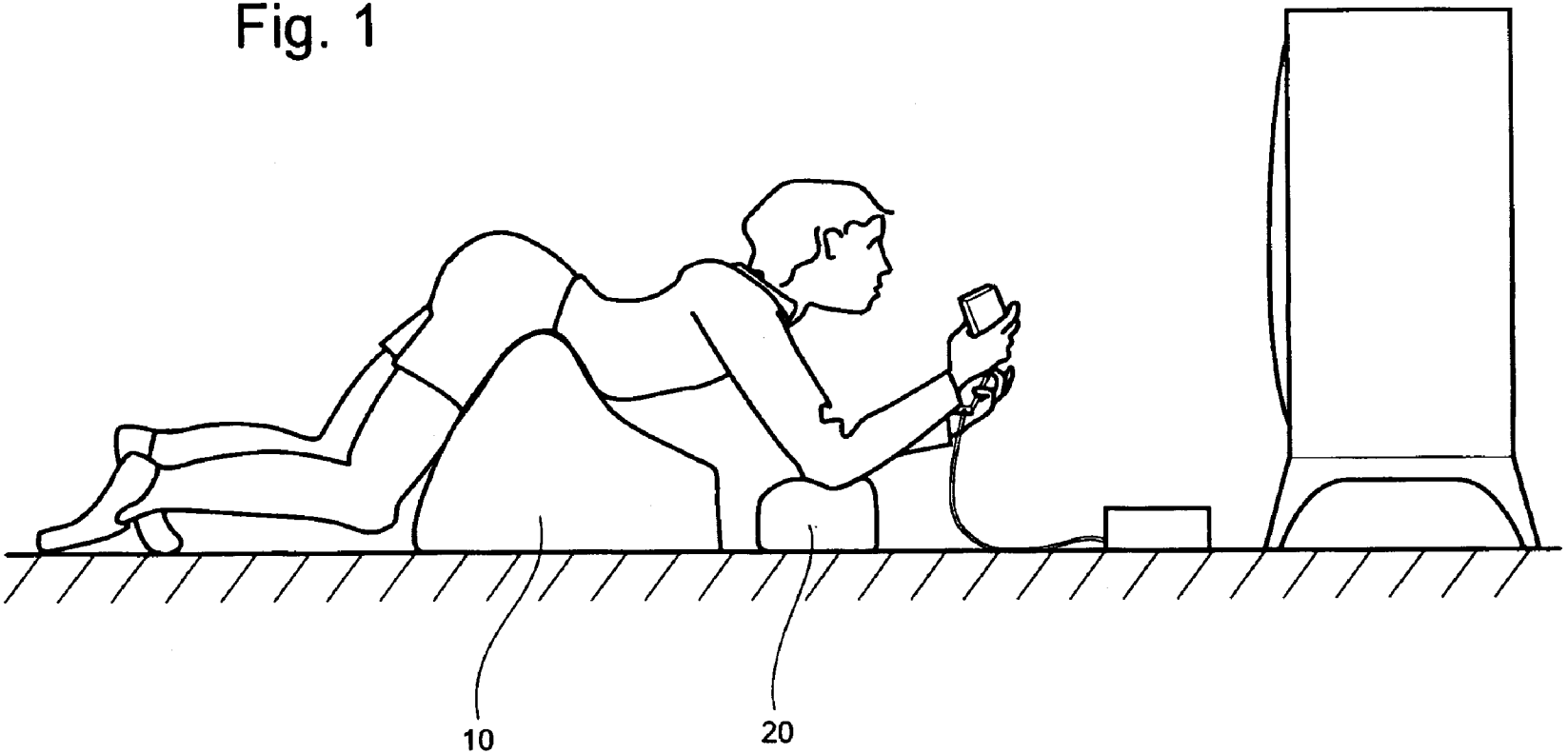
FIG. 1 is a perspective view illustrating the use of the body support for medical applications, according to the present invention.
Figure 5:
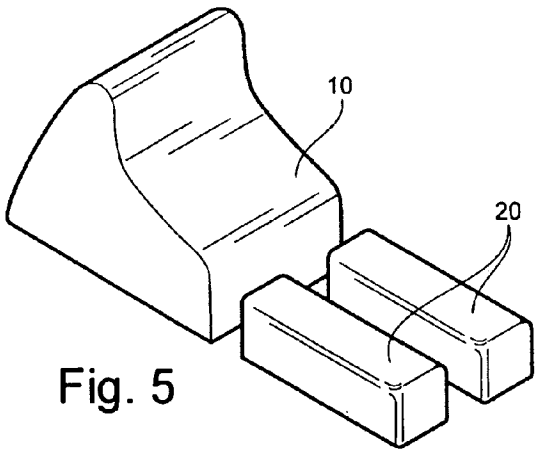
FIG. 5 is a perspective view of the body support with an alternate arm rest according to the present invention.
Figure 6:
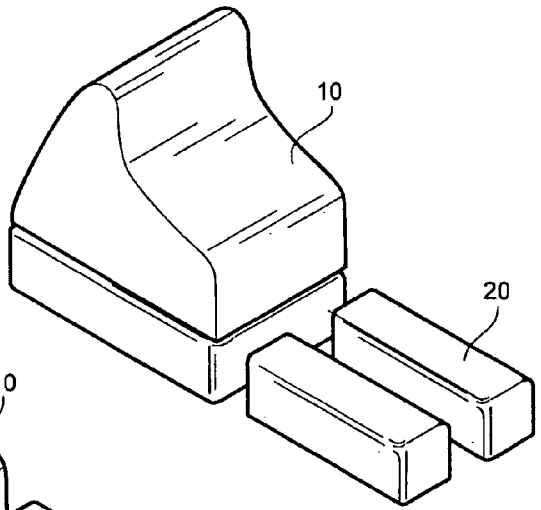
FIG. 6 is a perspective view of the body support with the alternate arm rest including the height adjustment pads according to the present invention.
Figure 7:
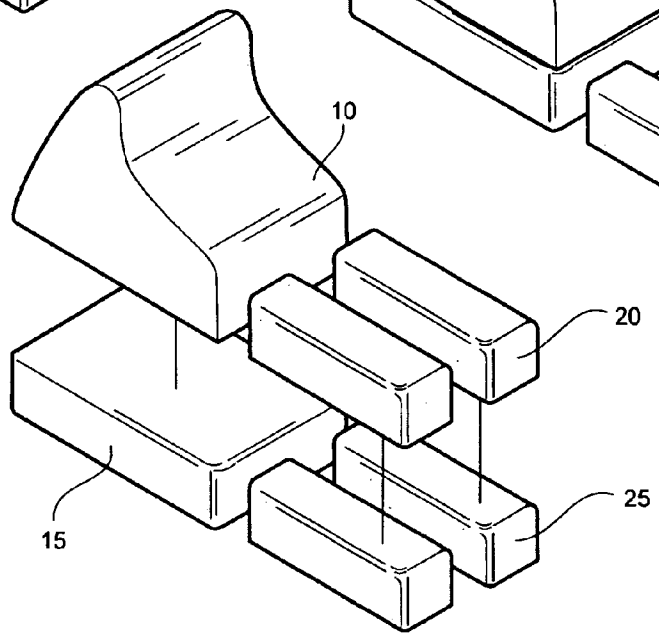
FIG. 7 is a perspective view of the body support with the alternate arm rest including multiple height adjustment pads according to the present invention.
Figure 8:
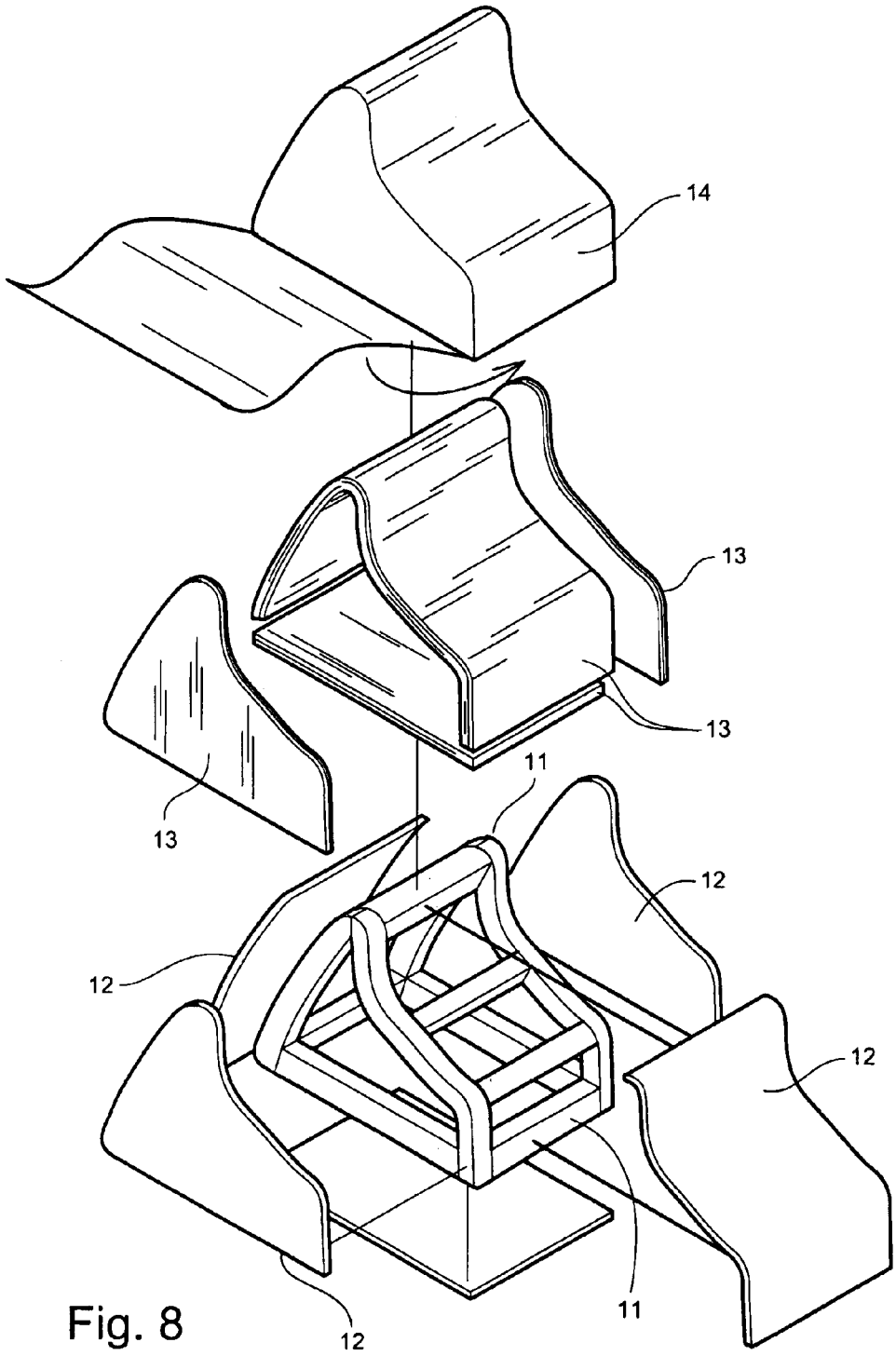
FIG. 8 is an exploded view of the present invention showing components of one embodiment according to the present invention.

The present invention is useful for supporting various body parts and positions in use in medical applications.

With reference to the figures, the present invention is a body support for medical applications 1 comprising a main body piece 10, at least one expansion piece 15, and at least one, preferably two arm pieces 20, which may have their own expansion pieces 25.

All of the pieces, 10, 15, 20, and 25, according to the present invention are preferably made of soft flexible materials. In one embodiment, the pieces, 10, 15, 20, and 25 are a soft cloth 14 covering containing an internal cushion 13 without an internal rigid frame 11. In an alternate embodiment the pieces, 10, 15, 20, and 25 are a soft cloth 14 covering containing an internal cushion 13 with an internal rigid frame 11. In yet another alternate embodiment, the pieces, 10, 15, 20, and 5 are a soft cloth 14 covering containing a rigid or quasi-rigid internal frame 11 covered with a cushioning padding 12, such as foam rubber, batting or the like.

In shape the main body piece 10 is preferably has a modified triangular prism. A triangular prism is a prism comprising of two modified triangular sides 19, a generally rectangular bottom (not shown), a generally rectangular back 16, and a curved, generally rectangular front or face side 18. The curved, generally rectangular front or face side 18 has a slightly concave shape. It is critical to the present invention that the partial concavity in the face side 18 is located adjacent the intersection of the face side 18 and the back 16. As seen in the Figures, a single concavity is located in the front or face side, proximate the intersection of the front side with the back, the single concavity being spaced from the middle of the front or face side. The reasons for the criticality of this location will be discussed below.

Prior art cushions contain generally triangular prisms with a curved face. All of these curved faces have the concavity in the center of the face, presumably to provide comfort to a user who is reclining their back on the curved face. The instant invention, however, addresses the comfort of a person who is generally in the prone position over the cushion. See especially FIG. 1. The concavity in the face side of the cushion needs to be near the apex of the triangle shape since it is designed to accommodate the projection of the abdominal portion of the body cavity when in this position. This allows the user to have their stomach in a slightly pushed out position, as opposed to a more compressed position that have the concavity in the center of the cushion would force. This slight pushed out position is what is required for maximum comfort to users who need to have lengthy suppositories for various medical treatments, thus the criticality of the location of the concavity in the front face side of the cushion.

Further, the interior of the main body piece 10 may include a variable inflation air chamber (not shown), located just underneath the curved face in order to provide variable stiffness to the curved face and variable curvature to fit the various girths found in typical users.

Attachable to the main body piece 10 is the at least one expansion piece 15. Each expansion piece 15 is preferably a cuboid having major faces that are at least the same size as the rectangular base side of the body 10. The attachment of the first expansion piece 15 is to the base side 17 of the main body piece 10 and is preferably removable and repeatable. Subsequent expansion pieces 15 would removably and repeatably attach to already attached expansion pieces 15 thereby providing an expandable base use to increase the height of the main body piece 10. These arm pieces 20 are included for further comfort when a user must stay in the prone position for extended periods of time, as is required by some medical treatments.

Attachable to the at least one expansion piece 15 are least two arm pieces 20. Each of the at least two arm pieces 20 are cuboids having sides a>b>c. Alternately, the arm pieces 20 may have their own arm expansion pieces 25, which are preferably the same size and shape as the arm pieces 20. Attachment of the arm pieces 20 to the arm expansion pieces 25 is by the same method as attachment of the body piece 10 to the expansion piece 15. These expansion pieces are useful for growing individuals, whose body size expands over the years, thereby reducing the need to repurchase the body support as the user grows.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A kit for body support in medical applications, adapted to support at least the abdominal portion and the arms of a prone user, comprising a main body piece, at least one expansion piece useful for raising the height of the main body piece, and at least one separate arm piece useful for supporting a person's arm, the main body piece shaped like a modified triangular prism comprising two modified triangular sides, a generally rectangular bottom, a generally rectangular back and a curved generally rectangular front defining a face side, wherein the curved generally rectangular front has a slightly concave shape with a single concavity located proximate the intersection of the face side and the back and spaced from the middle of the curved generally face side.

2. The body support according to claim 1 further comprising at least one arm piece expansion piece.

3. The body support according to claim 2 wherein the at least one expansion piece is a cuboid having major faces that are at least the same size as the rectangular base side of the main body piece.

4. The body support according to claim 3 wherein the at least one arm piece is a cuboid having sides of different sizes.

* * * * *